US011135733B2

(12) United States Patent
Moretti

(10) Patent No.: US 11,135,733 B2
(45) Date of Patent: Oct. 5, 2021

(54) SHAVING DEVICE

(71) Applicant: Anthony Moretti, Cranston, RI (US)

(72) Inventor: Anthony Moretti, Cranston, RI (US)

( * ) Notice: Subject to any disclaimer, the term of this patent is extended or adjusted under 35 U.S.C. 154(b) by 51 days.

(21) Appl. No.: 15/460,635

(22) Filed: Mar. 16, 2017

(65) Prior Publication Data

US 2017/0266827 A1 Sep. 21, 2017

Related U.S. Application Data

(60) Provisional application No. 62/309,104, filed on Mar. 16, 2016.

(51) Int. Cl.
*B26B 21/44* (2006.01)
*B26B 21/52* (2006.01)

(52) U.S. Cl.
CPC ..... *B26B 21/446* (2013.01); *B26B 21/522* (2013.01)

(58) Field of Classification Search
CPC ..... B26B 21/446; B26B 21/522
See application file for complete search history.

(56) References Cited

U.S. PATENT DOCUMENTS 3,810,305 A * 5/1974 Perry ..... B26B 21/24 30/346.58
4,129,942 A * 12/1978 Denizman ..... B26B 21/446 30/41
4,635,361 A * 1/1987 DeMars ..... B26B 21/446 30/41
4,753,006 A 6/1988 Howe
4,760,642 A * 8/1988 Kwak ..... A46B 11/0024 132/289
5,016,351 A * 5/1991 Drahus ..... B26B 21/446 30/41
5,018,543 A * 5/1991 Trillo Martinez ..... A45D 27/22 132/289
7,007,389 B1 3/2006 Aril
7,788,809 B2 9/2010 Tomassetti
2006/0150386 A1 7/2006 Wanli et al.
2006/0272154 A1 12/2006 Brevard
2015/0239138 A1 8/2015 Kurzet et al.

* cited by examiner

*Primary Examiner* — Kenneth E Peterson
*Assistant Examiner* — Liang Dong
(74) *Attorney, Agent, or Firm* — Boudwin Intellectual Property; Daniel Boudwin

(57) ABSTRACT

A device for shaving and dispensing material therefrom. The shaving device has a shaving head removably attached to a handle. The shaving head includes at least one blade to allow a user to cut hair. The handle has an internal cavity, wherein the internal cavity can be separated into two parts to allow insertion of a capsule containing a dispensable material, such as shaving cream or aftershave. The handle includes an opening adjacent to the shaving head and an outlet at the opposing end of the handle. The opening and the outlet allow the material from the capsule to be dispensed therethrough. The dispensable material may be dispensed at will by the user.

12 Claims, 3 Drawing Sheets

SHAVING DEVICE

CROSS REFERENCE TO RELATED APPLICATIONS

This application claims the benefit of U.S. Provisional Application No. 62/309,104 filed on Mar. 16, 2016. The above identified patent application is herein incorporated by reference in its entirety to provide continuity of disclosure.

BACKGROUND OF THE INVENTION

The present invention relates to shaving devices. Many individuals use creams, gels, oils, ointments or liquids while shaving. Often times these come in large containers so as to allow the consumer to use them regularly without having to replenish their supply. Keeping the containers on the counter of one's bathroom allows for convenience, but, at the cost of free space and aesthetics. This can result in containers being knocked over, broken, their contents spilt onto floors, surfaces, and rugs which would then need to be washed. It may also lead to embarrassing situations if guests ask to use the restrooms while a medicated topical agent is sitting out on the counter.

This also leads to complications and further potential embarrassment while travelling as not every one of these creams, gels, oils, ointments, or shaving liquids comes in a travel size permissible to be taken on a carry-on. Nor can they always be transferred easily to a container that holds the permissible amount. Furthermore, many of these bottles may break open during handling if put in regular luggage during air travel or may freeze and potentially burst when exposed to the low temperature environment of a plane's cargo hold. Therefore, there exists a need for a manner of minimizing containers and shaving paraphernalia.

SUMMARY OF THE INVENTION

In view of the foregoing disadvantages inherent in the known types of shaving device now present in the prior art, the present invention provides in one embodiment a shaving device with a shaving head housing a blade for cutting hair and a hollow handle separable into two parts where a capsule housing a dispensable material can be stored and subsequently dispensed through openings in the handle. Wherein the same can be utilized for providing convenience for the user when travelling or minimizing clutter.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
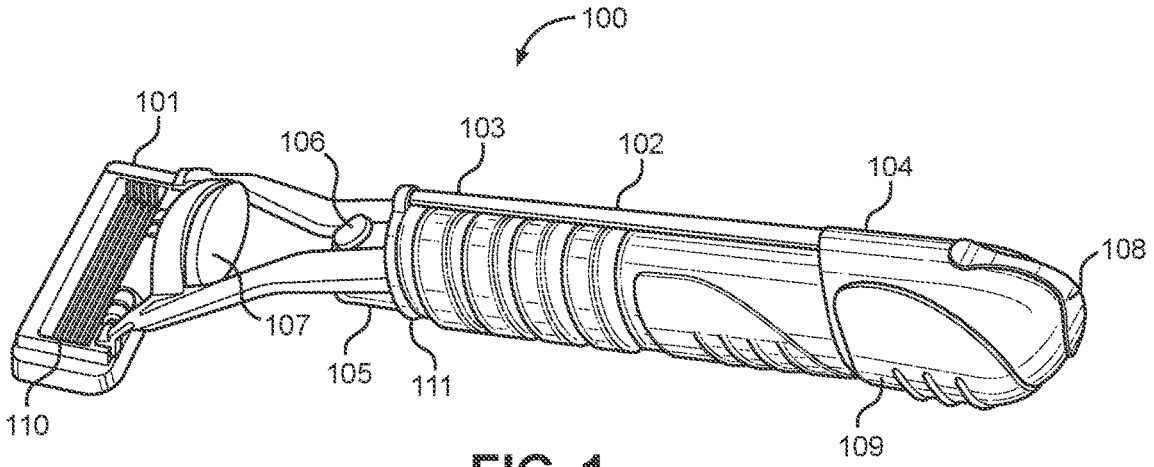
FIG. 1 shows a perspective view of an embodiment of the shaving device.

Reference is made herein to the attached drawings. Like reference numerals are used throughout the drawings to depict like or similar elements of the shaving device. The figures are intended for representative purposes only and should not be considered to be limiting in any respect. Unless specifically limited to a single unit, "a" is intended to be equivalent to "one or more" throughout the present disclosure.

Figure 2:
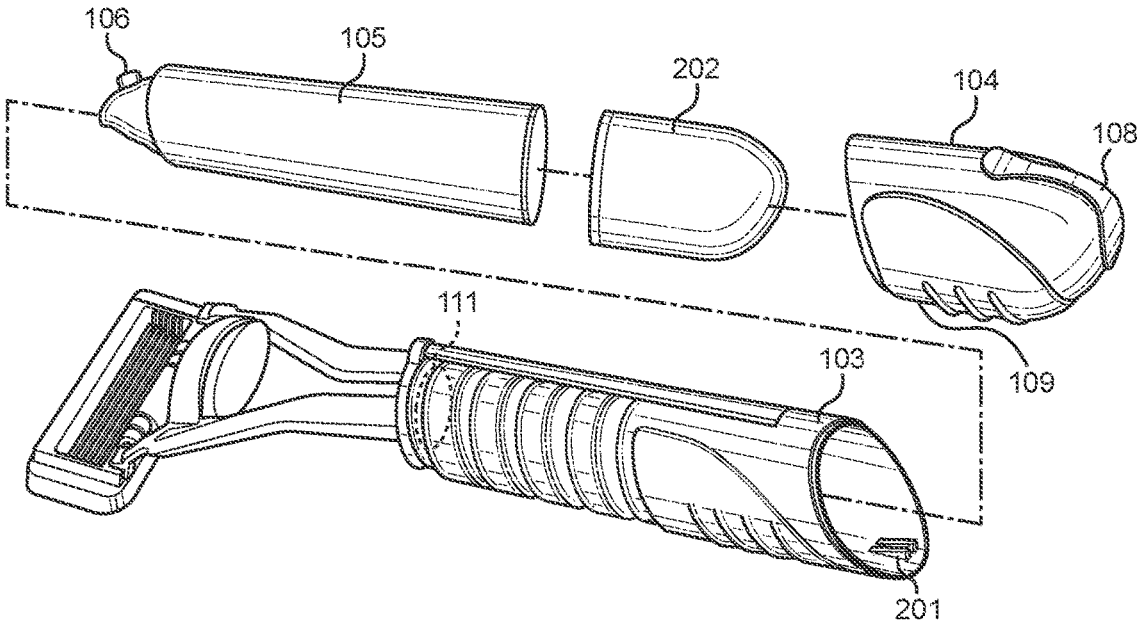
FIG. 2 shows an exploded view of an embodiment of the shaving device.

Referring now to FIGS. 1-2, there are shown a perspective view and an exploded view of an embodiment of the shaving device, respectively. The shaving device 100 includes a shaving head 101 and a handle 102 with an internal cavity. The shaving head 101 comprises a blade cartridge and a blade 110 therein and a quick-release button 107, wherein the blade is configured to cut hair. The quick-release button 107 is configured to eject a blade cartridge from the shaving head 101. The shaving head 101 of the shaving device 100 has a blade 110 housed in a disposable blade cartridge. In this embodiment, a user may eject the blade cartridge by pressing the quick-release button 107. In other embodiments, the shaving head 101 cannot eject the blade 110 and may not be a cartridge razor in the meaning of that term as used by those of ordinary skill in the art. In other embodiments, the shaving device 100 is a disposable razor within the meaning of that term as used by those of ordinary skill in the art. The shaving head 101 may be affixed to the handle 102 by any means known to one of ordinary skill in the art. The handle 102 comprises a first part 103 with the proximal end of the handle 102 affixed to the shaving head 101, and a second part 104 with the distal end of the handle 102 which is separable and affixes to the first part 103. The first part 103 of the handle 102 is removably affixed to the second part 104 by friction fit, screw thread, hinges, or any other suitable means known to one of ordinary skill in the art. The proximal end of the handle 102 has an opening 111 through which a protruding first capsule 105 is configured to extend. The opening 111 is smaller than the body of the first capsule 105 and larger than the upper end of the first capsule 105 thereby allowing the upper end to extend out through the opening 111 but preventing the first capsule 105 from exiting through the opening. The distal end of the handle 102 has an outlet 402 through which a dispensable material 403 may be released.

In the illustrated embodiment, the protruding first capsule 105 is inserted along a guide rail 201 into the first part 103. The guide rail 201 is positioned on the lower surface of the first part 103 and ensures proper positioning of a first capsule 105 by restricting the first capsule's 105 resting position and potential movement. The guide rail 201 in the illustrated embodiment is a pair of planar triangles rising perpendicularly from the lower surface of the first part 103 and made of the same material as the first part 103. In other embodiments, the guide rail 201 takes other forms, is made of other materials, is located on the second part 104, is located on both the first part 103 and the second part 104, or is not present in the embodiment. As one example, FIG. 3 shows a guide rail 305 disposed on the interior of the second part 104.

In the illustrated embodiment, the protruding first capsule 105 is a pressurized shaving cream container. The first capsule 105 has a button 106 located at the upper end of the first capsule 105. When the button 106 is pressed the first capsule 105 ejects dispensable material 403, shaving cream, from the first capsule 105. When the first capsule 105 is inserted into the first part 103 the button 106 extends through the opening 111 and is completely outside of the first part 103. In the illustrated embodiment, the first capsule 105 when inserted is aligned so that shaving cream would dispense from the same side of the shaving device 100 that the cutting edge of the blade 110 is located on and the button 106 would be located on the opposite surface of the first capsule 105.

Figure 3:
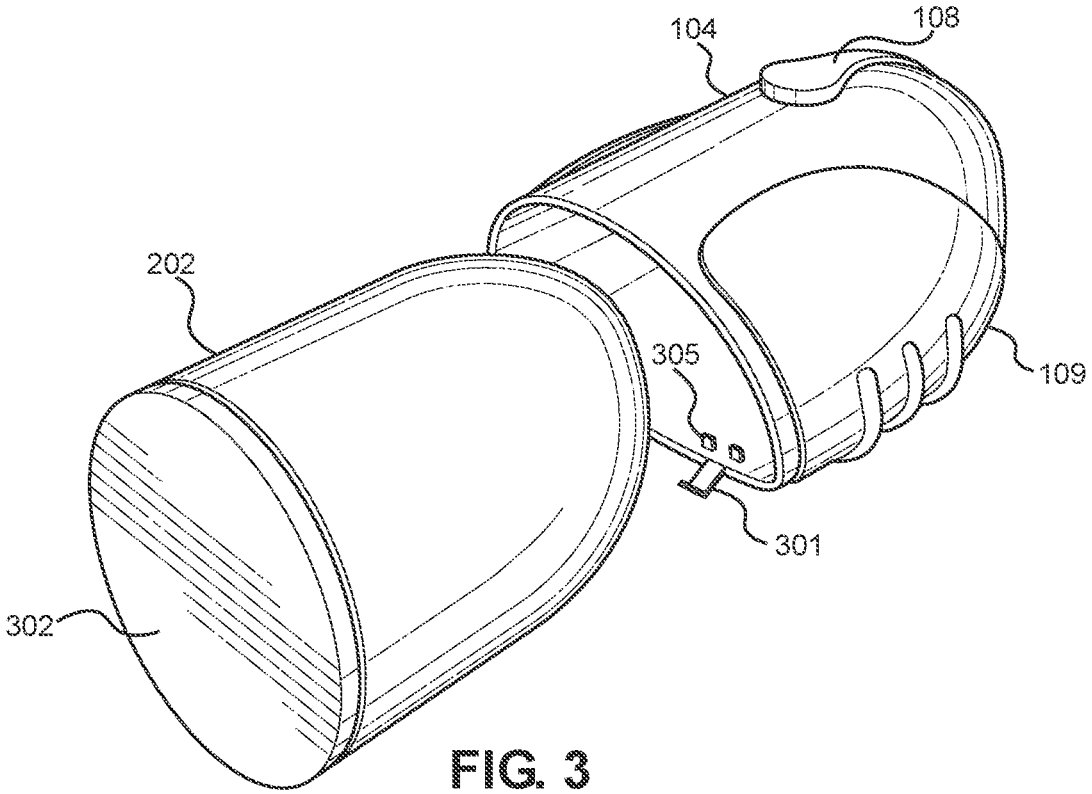
FIG. 3 shows an exploded view of the second part of an embodiment of the shaving device.

Referring now to FIG. 3, there is shown an exploded view of the second part of an embodiment of the shaving device. In the illustrated embodiment, a second capsule 202 is disposed in the second part 104 of the handle. The second capsule 202 is configured to be inserted into the second part 104 and held in place by a hinged hook 301. The hinged hook 301 is located at the entrance to the second part 104 and presses against the back wall 302 of the capsule 202 to physically restrain it. In this embodiment, the capsule 202 is a non-pressurized container of aftershave. In other embodiments, the hinged hook 301 is located on the first part 103, both the first part 103 and the second part 104, or is not present.

Figure 4:
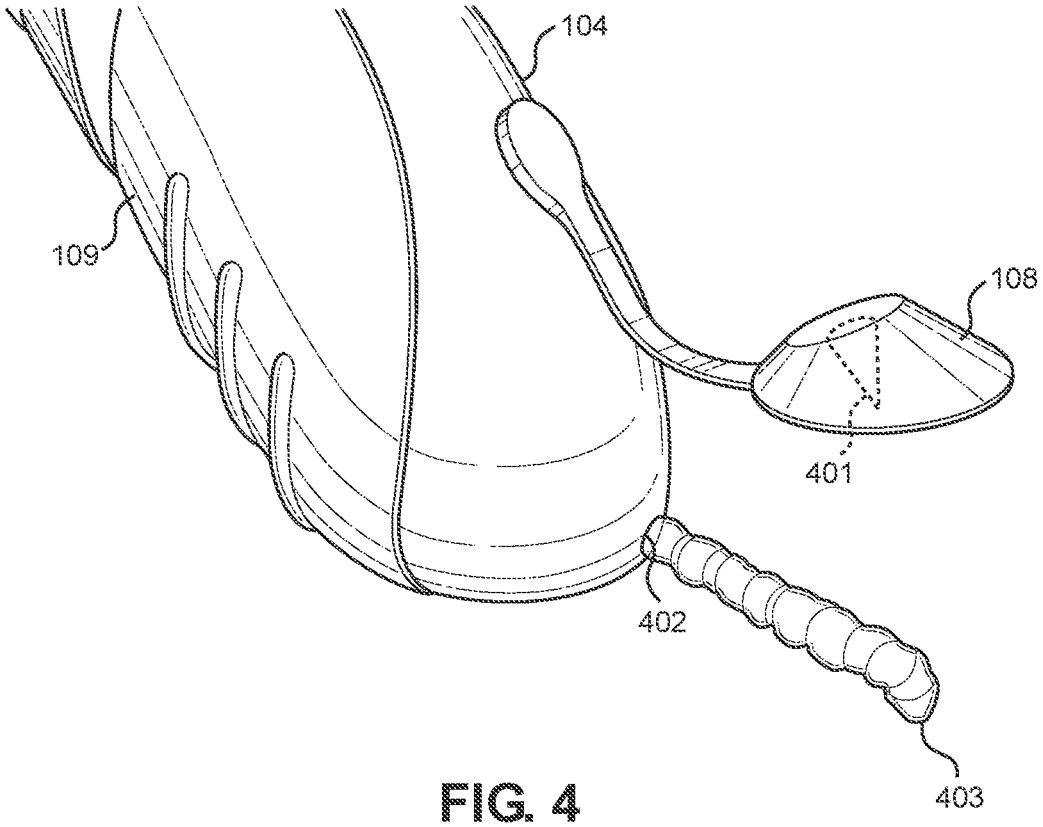
FIG. 4 shows a close-up view of the second part of an embodiment of the shaving device in use.

Referring now to FIG. 4, there is shown a close-up view of the second part of an embodiment of the shaving device in use. The distal end of the handle 102 has an outlet 402, through which dispensable material 403 held by the second capsule. In the illustrated embodiment, the dispensable material held in the second capsule comprises aftershave. The dispensable material 403 may be released from the second capsule through an opening on the second capsule and the outlet 402 via gravity, fluid dynamics, and physical shaking of the shaving device. The opening 111, and the outlet 402 vary in size and shape in various embodiments. The outlet 402 and the opening of the second capsule 202 are plugged by a cap 108 with a plug 401 located on the interior surface of the cap 108. In the illustrated embodiment, the cap 108 and plug 401 are composed of rubber. In the illustrated embodiment, the cap 108 is affixed to the second part 104 of the handle 102. The rubber cap 108 and the rubber plug 401 take other forms in other embodiments or are not present.

In some embodiments, the exterior of the handle comprises rubber grips 109 to aid with use with of the shaving device. In the illustrated embodiment, the rubber grips 109 are ridges disposed at fixed intervals along the exterior portion of the handle near the separation point for the first part and the second part. Other embodiments also do not have a rubber grip 109 or have other types of grips such as cross-hatch pattern cut or etched into the handle.

The first and second capsules 105, 202, vary in internal pressure, size, shape, material, dispensable material 403, as well as how the dispensable material 403 may be dispensed. The first and second capsules 105, 202 are configured to fit within the handle 102 and to be able to dispense their contents therefrom. The first and second capsules 105, 202 are guided into place by the guide rail 201 or held into place by hinged hooks 301, although, in some embodiments the first and second capsules 105, 202 are both guided into place by the guide rail 201 and held in place by hinged hooks 301, while in other embodiments neither are present.

Figure 5:
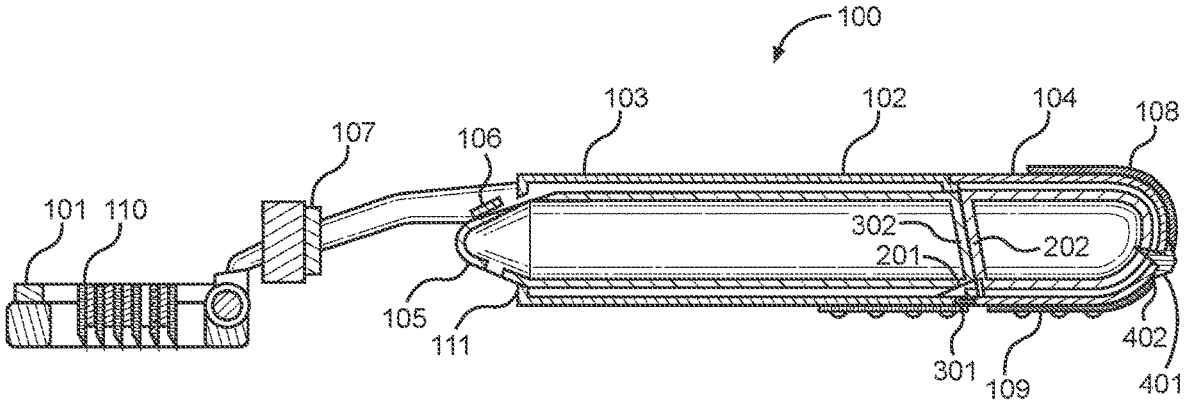
FIG. 5 shows a cross-sectional view of an embodiment of the shaving device in use.

Referring now to FIG. 5, there is shown a cross-sectional view of an embodiment of the shaving device. The cross-sectional view shows the first capsule 105 positioned within the first part 103 of the handle 102 and resting upon the guide rail 201. The portion of the first capsule 105 having the button 106 thereon extends through the opening 111 on the first part 103 of the handle 102. The hinged hook 301 presses against the back wall 302 of the capsule 202. The capsule 202 is flush against the sides of the interior cavity and is configured to align with the outlet 402 so that when the cap 108 is removed therefrom, dispensable material 403 is released from the second part 104 of the handle 102. In the illustrated embodiment, the first capsule 105 and the second capsule 202 have a small space in between where the hinged hook 301 and the guide rail 201 are located.

Figure 6:
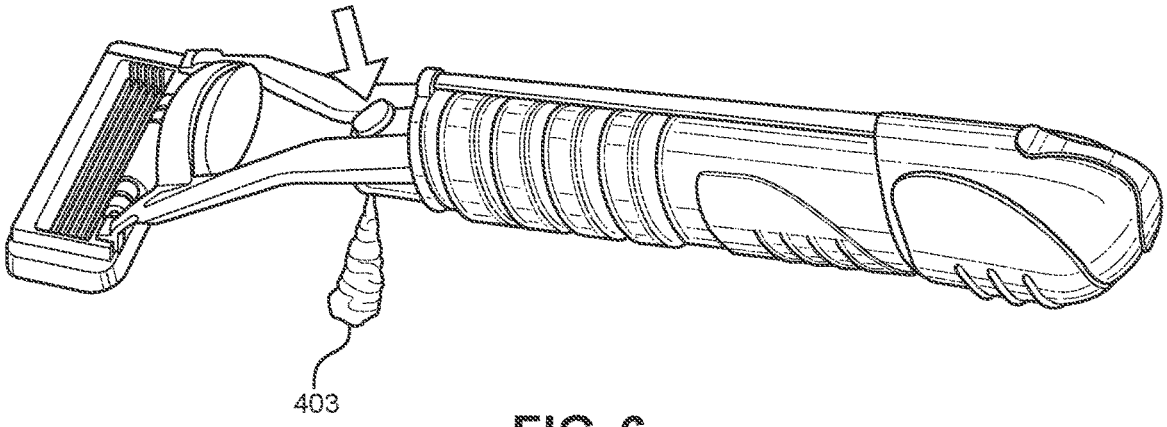
FIG. 6 shows a perspective view of an embodiment of the shaving device in use.

Referring now to FIG. 6, there is shown a perspective view of the shaving device in use. In the illustrated embodiment, a user wishing to either minimize clutter, or travel, uses the shaving device. The user presses the button causing the first capsule to eject its dispensable material 403, shaving cream, into the hand of the user.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A shaving device, comprising:

a shaving head and a handle, wherein the handle includes an internal cavity;

wherein the handle is separable into a first part affixed to the shaving head, and a second part removably secured to the first part;

a first opening at an end of the first part of the handle;

a second opening at an end of the second part of the handle a first capsule and a second capsule each disposed in the internal cavity with the second capsule coaxially aligned with the first capsule, wherein the first capsule is configured to house and dispense a first dispensable material and the second capsule is configured to house and dispense a second dispensable material;

a cap removably secured over the second opening, wherein the second opening is aligned with a corresponding second outlet on one end of the second capsule;

wherein the first opening includes a diameter smaller than a diameter of the first capsule, such that the first capsule is prevented from moving entirely through the first opening when loaded into the internal cavity, wherein the first capsule includes a first outlet extending beyond the first opening;

wherein the shaving head comprises a blade configured to cut hair.

2. The shaving device of claim 1, wherein:

the first capsule is pressurized.

3. The shaving device of claim 1, wherein:

the second capsule is pressurized.

4. The shaving device of claim 1, wherein:
the first capsule holds a different dispensable material than the second capsule.

5. The shaving device of claim 1, wherein:
the cap is adapted to plug the second opening outlet and the corresponding second outlet of the second capsule.

6. The shaving device of claim 1, wherein:
the first part and the second part each comprise threading adapted to secure to one another.

7. The shaving device of claim 1, further comprising:
a grip disposed on the handle configured to provide a non-slip surface.

8. The shaving device of claim 1, further comprising:
a hinged hook disposed on the interior of the first part configured to hold in position the first capsule.

9. The shaving device of claim 1, further comprising:
a hinged hook disposed on the interior of the second part configured to hold in position the second capsule.

10. The shaving device of claim 1, further comprising:
a first guide rail disposed on the interior of the first part configured to guide the first capsule into an operable position.

11. The shaving device of claim 1, further comprising:
a second guide rail disposed on the interior of the second part configured to guide the second capsule into an operable position.

12. The shaving device of claim 1, wherein:
the first capsule has a button configured to dispense dispensable material when pressed.

* * * * *